United States Patent [19]

Handfield

[11] Patent Number: 4,711,395

[45] Date of Patent: Dec. 8, 1987

[54] METHOD AND APPARATUS FOR MAKING SNOW

[76] Inventor: Louis Handfield, 95, Sault Au Matelot, #5, Quebec City, Quebec, G1K 3Y9, Canada

[21] Appl. No.: 808,506

[22] Filed: Dec. 13, 1985

[51] Int. Cl.[4] ..... F25C 3/04

[52] U.S. Cl. ..... 239/14.2; 415/213 C

[58] Field of Search ..... 239/2 S, 14, 77, 2.2, 239/14.2, 2.5; 62/74; 415/116, 117, 213 C; 417/354

[56] References Cited

U.S. PATENT DOCUMENTS

| | | | |
|---|---|---|---|
| 3,567,117 | 3/1971 | Eustis | 239/2 S |
| 3,945,567 | 3/1976 | Rambach | 239/14 |
| 3,948,442 | 4/1976 | Dewey | 239/2.2 |
| 4,223,836 | 9/1980 | Eager | 239/14.2 X |
| 4,475,688 | 10/1984 | Hodges | 239/2 S |
| 4,516,723 | 5/1985 | Hesse | 239/77 |
| 4,573,636 | 3/1986 | Dilworth et al. | 239/14 X |

FOREIGN PATENT DOCUMENTS

| | | | |
|---|---|---|---|
| 945477 | 7/1982 | U.S.S.R. | 239/14 |

*Primary Examiner*—Andres Kashnikow
*Assistant Examiner*—Mary Beth O. Jones

[57] ABSTRACT

A machine for producing artificial snow includes an elongated cylindrical outer casing with a frusto-conical discharge end; a similar inner casing, a tubeaxial fan in the outer casing for creating an annular stream of turbulent air at the discharge end of the outer casing; an adjustable turbine nozzle centrally located at or near the discharge end of the outer casing for spraying a stream of water droplets into the turbulent air to create a stream of water droplets and air; and nucleators at or near the discharge end of the outer casing for spraying very fine droplets of water or nuclei into the stream of water droplets and air, whereby, temperature permitting, a stream of artificial snow is created without large droplets of water or ice dribbling from the stream near the discharge end of the outer casing.

7 Claims, 5 Drawing Figures

METHOD AND APPARATUS FOR MAKING SNOW

BACKGROUND OF THE INVENTION

1. Field of the Invention

This invention relates to a snowmaking method and machine for producing artificial snow.

2. Discussion of the Prior Art

There is a large number of patented and/or currently available machines for creating artificial snow. Typical of such machines are those described in Canadian Pat. Nos. 791,579, issued to Atlas Copco Aktiebolag on Aug. 6, 1968; 873,089, issued to F. J. Achmuhle et al. on June 15, 1971; 925,713, issued to Hedco, Inc. on May 8, 1973 and 1,028,514, issued to P. L. Tropeano et al on Mar. 28, 1978, and U.S. Pat. Nos. 3,494,559, issued to C. M. Skinner on Feb. 10, 1970; 3,774,843, issued to B. A. Rice on Nov. 27, 1973; 3,831,844, issued to J. C. Tropeano et al on Aug. 27, 1974 and 3,945,567, issued to G. Rambach on Mar. 23, 1976.

In general, the available machines are designed to create a mist defined by a large number of fine droplets of water, and to freeze the droplets before they reach the ground. Perhaps the three most important considerations when making artificial snow are (i) proper mixing of the droplets and air, (ii) maintaining the droplets airborne for a period of time sufficient to ensure freezing and (iii) keeping energy consumption at a minimum.

It has been found that not only are existing machines not energy efficient, but they are somewhat lacking in their ability and efficiency to convert all of the water blown through the machines into snow. Because the machines employ a single, central stream of air and spray water into the airstream from the outside, many water droplets fall from the airstream creating a so-called "dribbling effect", i.e. large droplets of water fall to the ground before freezing.

The object of the present invention is to overcome the problems encountered with existing machines by providing a relatively simple, energy efficient snowmaking machine and method, which ensure proper mixing of air and water, and good heat exchange between atmospheric air and the air/water mixture.

GENERAL DESCRIPTION OF THE INVENTION

According to one aspect, the present invention relates to a machine for making artificial snow comprising elongated, cylindrical, tubular outer casing means; fan means in said outer casing means for drawing air into an inlet end and discharging an initially annular, diverging stream of air from a discharge end thereof; turbine nozzle means located centrally of said outer casing means for spraying water into the centre of said stream of air at the discharge end of the outer casing means to create a diverging stream of air-carried water droplets downstream of the discharge end of said outer casing means; and nucleator means for mixing a jet of air and water to form very fine droplets of water, defining nuclei to promote snow formation; and for spraying said nuclei into the stream of air carried water droplets at a location at or immediately downstream of said discharge end of said outer casing means, whereby, temperature permitting, the water droplets adhere to the nuclei to form snow while airborne.

In accordance with another aspect, the present invention relates to a method of making artificial snow comprising the steps of forming a flaring stream of air of circular cross section; spraying a stream of water droplets into the centre of said flaring, turbulent stream of air to form a mixture of air and water droplets; and spraying a fine jet of air/water nuclei into said flaring mixture to form snow, temperature permitting.

The casing used in the machine of the present invention is equipped with an elongated frusto-conical discharge nozzle, which reduces the backdraft problem sometimes encountered with existing machines. Under windy conditions, the water mist forming at the periphery of a machine outlet may be blown back and aspirated into the unit to freeze up the unit. By using a long, tapered nozzle there is less chance of backdraft occurring. Another advantage of a long tapered discharge air nozzle and a central water nozzle is that the water remains in the air for a long period of time, with good mixing between atmospheric air and the air/water mixture.

The use of a central, adjustable water supply nozzle obviates the need encountered with existing machines to periodically adjust a plurality of peripheral nozzles for gallonage selection. Moreover, unlike peripheral nozzles, a central nozzle can be opened fully to flush any ice formed at the discharge end thereof. It is common to provide a blow torch with existing snowmaking machines for thawing frozen nozzles. A single central water nozzle is less expensive than a plurality of peripheral nozzles and requires less plumbing to carry water to the nozzles.

BRIEF DESCRIPTION OF DRAWINGS

The invention will now be described in greater detail with reference to the accompanying drawings, which illustrate preferred embodiments of the invention, and wherein.

DESCRIPTION OF PREFERRED EMBODIMENTS

Figures 1, 2:
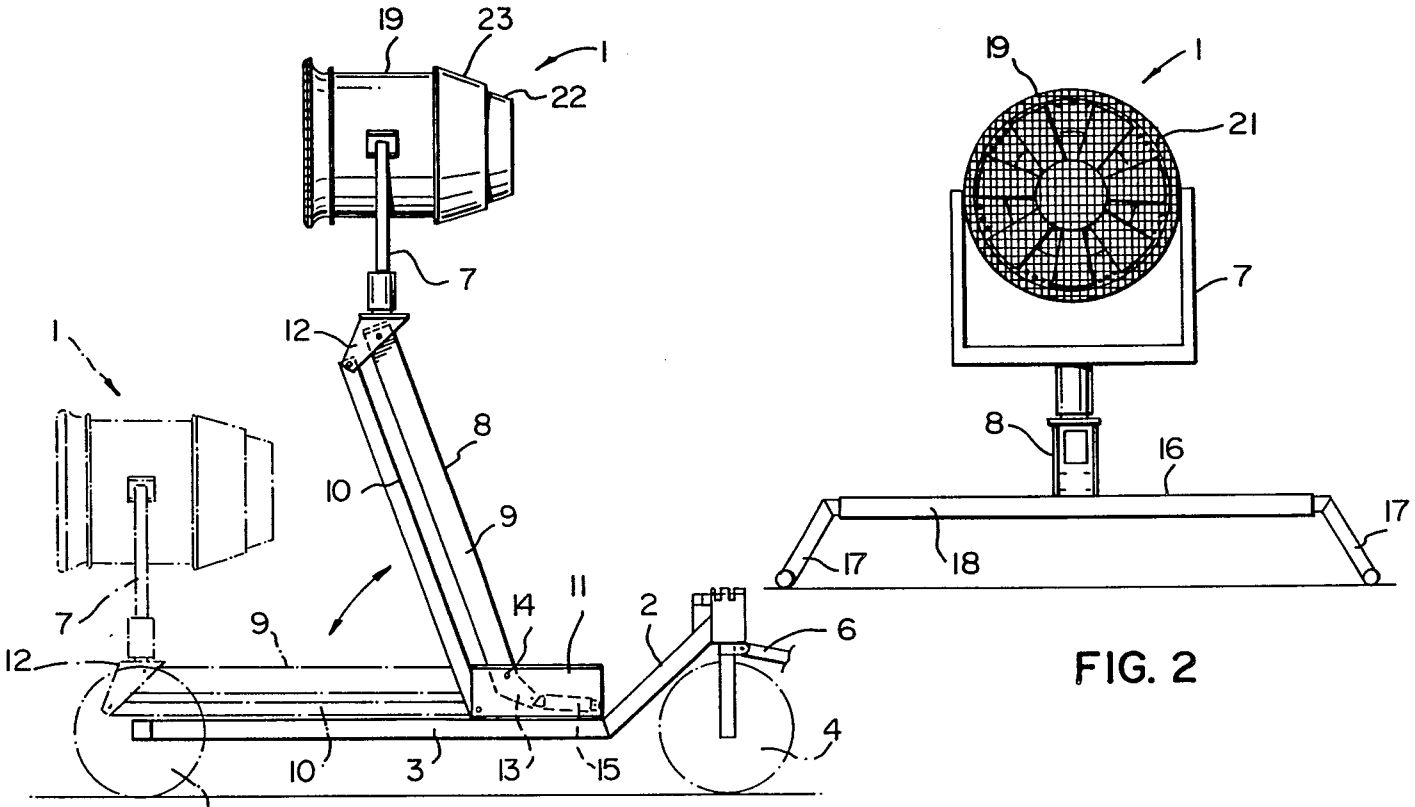
FIG. 1 is a side elevation view of a snowmaking machine in accordance with the present invention mounted on a trailer.
FIG. 2 is a rear view of the machine of FIG. 1 mounted on a platform.

With reference to the drawings, a snowmaking machine in accordance with the present invention generally indicated at 1 is normally mounted on a trailer 2, which carries the machine to a location for use. The trailer 2 is defined by a generally triangular frame 3, a front wheel 4, and a pair of rear wheels 5 (one shown) supporting the frame, and a tow bar 6 for connecting the frame 3 to a towing vehicle. The snowmaking machine 1 is pivotally mounted in a Y-shaped frame 7 on one end of a boom 8 for rotation around a horizontal axis. The frame 7 is rotatably mounted on the boom 8 for rotation around a vertical axis. Thus, the angle of inclination and the direction of discharge of the machine can readily be changed.

The boom 8 includes a pair of arms 9 and 10, both of which are pivotally connected to the sides of a rectangular clevis or bracket 11 at horizontally and vertically spaced apart locations. The bracket 11 is mounted on the front end of the frame 3. A second, inverted U-shaped bracket 12 is pivotally connected to the top ends of the arms 9 and 10, and the frame 7 is mounted on the bracket 12. Thus, the arms 9 and 10, and the brackets 11 and 12 define a parallelogram linkage for raising and lowering the machine 1. The front end 13 of the arm 9 extends beyond the pivot axis 14 in the bracket 11 and is pivotally connected to the outer end of the piston rod of a hydraulic cylinder 15. The cylinder 15 is pivotally mounted in the frame 11. Extension of the piston rod causes rotation of the boom 8 from the horizontal or transport position (phantom outline in FIG. 1) to the elevated or use position shown in solid outline in FIG. 1. Hydraulic fluid can be pumped to the cylinder 15 manually using a commercially available pump (not shown).

Alternatively, the machine 1, frame 7 and boom 8 can be mounted on a triangular skid 16 (FIG. 2). In such case, a pair of legs 17 are connected to the rear crossbar 18 of the skid, and a single leg (not shown) replaces the front wheel 4. The skid 16 can be carried between locations using a conventional flatbed trailer (not shown).

Figures 3, 4, 5:
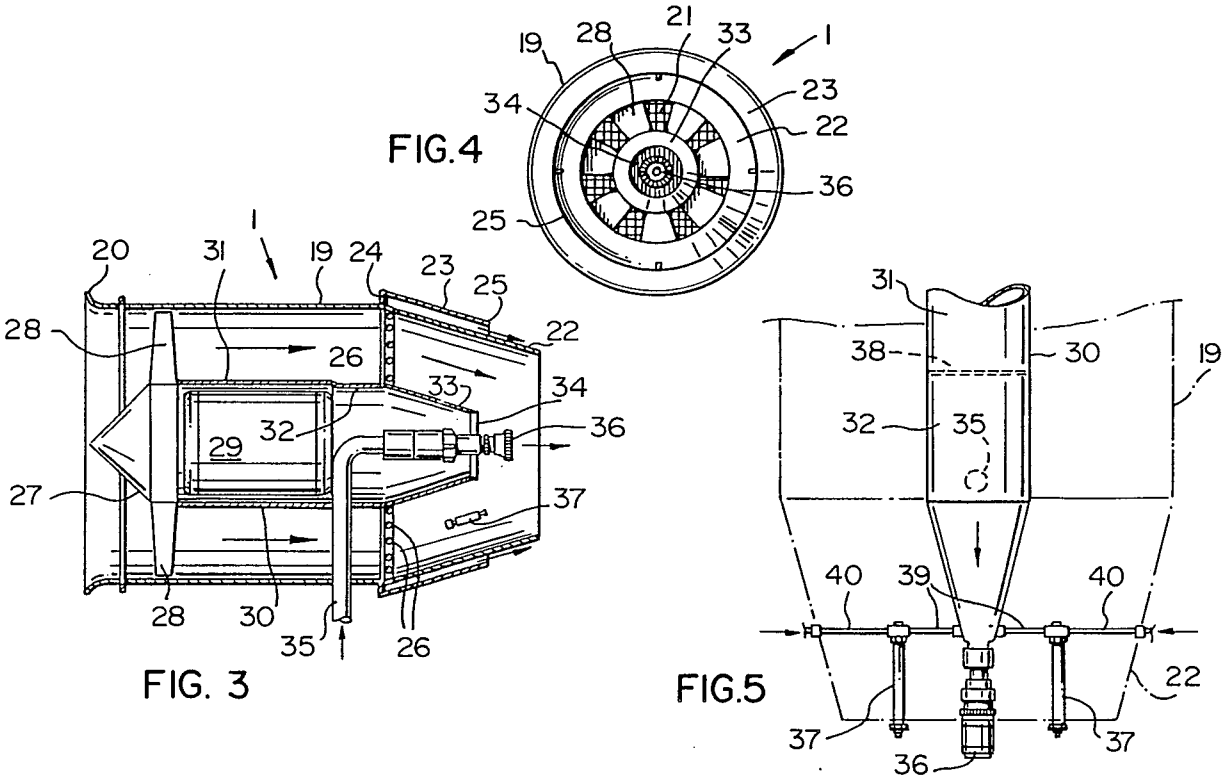
FIG. 3 is a longitudinal sectional view of the machine of FIGS. 1 and 2.
FIG. 4 is a front view of the machine of FIGS. 1 to 3.
FIG. 5 is a schematic plan view of the discharge end of a second embodiment of the machine of the present invention, with parts omitted.

With particular reference to FIG. 4, the snowmaking machine 1 includes an elongated, tubular outer casing 19, which is cylindrical throughout most of its length. The rear, inlet end 20 of the casing 19 is slightly flared to promote the flow of air into the casing. A screen 21 (FIG. 2) protects the open rear or inlet end 20 of the casing. The discharge end of the casing 19 is defined by an elongated frusto-conical nozzle 22. A frusto-conical cowl 23 is provided on the discharge end of the casing 19. The cowl 20 has a closed rear end 24 and an open front or discharge end 25 through which secondary air is discharged. A plurality of openings 26 are provided around the periphery of the casing 19 and the rear end of the nozzle 22 for discharging air into the cowl 23. A tubeaxial fan 27 is mounted coaxially in the casing 19, i.e. with the longitudinal axis of the fan on the longitudinal axis of the casing 19 for drawing air into the rear inlet end 20 of the casing and discharging the air through the nozzle 22. The use of a tubeaxial fan (instead of a vaneaxial fan) increases the volume of air by approximately 20% for the same horsepower at the same static pressure. A tubeaxial fan also causes twisting or spiral movement of the airstream which results in better mixing and heat exchange between the airstream and ambient or atmospheric air. The fan 27 includes the usual blades 28, which are rotated by an electrical motor 29. The motor 29 is mounted in a cylindrical inner casing 30, which is coaxial with the outer casing 19. The casing 30 is defined by a rear or inlet section 31 containing the motor 29, a smaller diameter intermediate section 32 and a frusto-conical outlet section 33, with a closed end 34.

A water pipe 35 connected at one end to a source of water (not shown) under pressure enters the intermediate section 32 of the casing 30 and bends forwardly to a discharge nozzle 36. The nozzle 36 is a semi or fully automatic nozzle of the type which contains spinning turbine teeth, a calibrated volume control, an adjustable combination fog/straight stream pattern and a remote control adapting kit for automatic volume and pattern control. The spinning turbine teeth break up the water to the droplet size ideal for snowmaking and form a power fog cone for better control of the pressurized water. Such a nozzle is designed to make the desired snow by spraying the proper volume of water in the right form to the right location. Moreover, the spinning turbine creates a fog which promotes heat exchange between the air and water, thus giving the snow the desired qualities. A suitable nozzle is sold by the Akron Brass Company, a division of Premier Industrial under the trademark Turbojet. The nozzle is normally used on fire fighting equipment.

The nozzle 36 is mounted in the end wall 34 of the casing 30 near the open discharge end of the nozzle 22. The arrangement is such that the central cone of water discharged by the nozzle 36 almost immediately intersects the annular air stream created by the fan 27 to create a swirling mixture of water droplets and air. At the same time nucleators 37 (one shown) mounted in the nozzle 22 inject streams of water nuclei or very small water droplets in air into the combined water and air mixture. The nuclei, being extremely small, freeze first creating nuclei for the formation of snow. The nucleators 37 are connected to sources (not shown) of water and air under pressure. The air under pressure is normally a compressor carried by the trailer 2.

Referring to FIG. 5, in an alternative structure, the rear section 31 of the inner casing 30 is separated from the intermediate section 32 by a partition 38 so that the intermediate section 32 of the casing defines a water inlet manifold. The inlet pipe 35 merely introduces water under pressure into the inlet manifold. Some of the water passes through outlet tubes 39 near the discharge end of the outlet section 33 of the casing 30 to the rear, inlet ends of the nucleators 37. Air under pressure is introduced into the nucleators 37 via inlet pipes 40. In the second embodiment of the invention, the nozzle 36 and the nucleators 37 extend outwardly beyond the discharge end of the nozzle 22, so that all mixing of air and water occurs outside of the casing 19.

In operation, the tubeaxial fan 27 creates a turbulent stream of air which is discharged through the nozzle 22 under pressure. At the same time, a central stream of water droplets is injected into the airstream at or immediately downstream of the discharge end of the casing 19. It will be appreciated most of the mixing occurs downstream of the casing 19. The optional cowl 23 creates an annular stream of air which has the dual effect of promoting mixing and maintaining the discharge from the casing 19 in a small area until the air water mixture is well clear of the machine. The shape and path of the air and water stream are also affected by the height and inclination of the casing 19 on the boom 8, and the pressure and shape of the water jet discharged from the nozzle 36.

It will also be appreciated that with the structure proposed hereinbefore the air and water at least maintain their momentum following discharge from the fan and nozzle. By spraying the water into the centre of the airstream, the momentum of the water and air are combined to produce an expansion pattern which enhances heat exchange and lengthens the flight time of the mixture. The water and air droplets flow in the same direction and larger droplets of water move naturally in the same direction as the air/water mixture instead of passing through the airstream to the ground (the so-called dribbling effect).

I claim:

1. A machine for making artificial snow comprising elongated, cylindrical, tubular outer casing means; elongated, cylindrical, tubular inner casing means in and coaxial with said outer casing means; fan means carried by said inner casing means in said outer casing means for drawing air into an inlet end and discharging an initially annular converging stream of air from a discharge end of said outer casing means; turbine nozzle means on said inner casing means and located on the longitudinal axis of said outer casing means proximate the discharge end thereof for spraying water into the centre of said stream of air at said discharge end of the outer casing means to create a diverging stream of air-carried water droplets downstream of the discharge end of said outer casing means; and nucleator means mounted in said outer casing means between said outer and inner casing means proximate the discharge end of the outer casing means for mixing a jet of air and water to form very fine droplets of water, defining nuclei to promote snow formation, and for spraying said nuclei into the stream of air carried water droplets at a location at or immediately downstream of said discharge end of said outer casing means, whereby, temperature permitting, the water droplets adhere to the nuclei to form snow while airborne.

2. A machine according to claim 1, wherein said outer casing means includes an elongated, frustoconical discharge nozzle at the discharge end thereof, whereby the stream of air created by said fan means is initially annular and tapering downstream in the direction of flow of the airstream.

3. A machine according to claim 2, wherein said fan means is a tubeaxial fan for creating a turbulent airstream for discharge from said outer casing means.

4. A machine according to claim 2, wherein said turbine nozzle means is located in said discharge end of said outer casing means on the longitudinal axis thereof and projecting out of the downstream end of said outer casing means.

5. A machine according to claim 1, including annular cowl means around the discharge end of said outer casing means for receiving air under pressure and discharging the air in an annular stream to the airstream from said discharge end of said outer casing means.

6. A machine according to claim 1, including inlet manifold means in said inner casing means downstream of said fan means in the direction of travel of the air for receiving water from a source of water under pressure, said turbine nozzle means extending into said inlet manifold means for receiving water therefrom.

7. A machine according to claim 6, including pipe means connecting said inlet manifold means to said nucleator means for supplying water thereto.

* * * * *